United States Patent [19]

Bedell et al.

[11] Patent Number: 4,592,411

[45] Date of Patent: Jun. 3, 1986

[54] METHOD OF AND APPARATUS FOR CONTINUOUSLY CASTING METAL FILAMENT IN A VACUUM

[75] Inventors: John R. Bedell, Madison; Howard H. Liebermann, Succasunna, both of N.J.

[73] Assignee: Allied Corporation, Morris Township, Morris County, N.J.

[21] Appl. No.: 606,805

[22] Filed: May 3, 1984

Related U.S. Application Data

[63] Continuation-in-part of Ser. No. 458,250, Jan. 17, 1983, abandoned.

[51] Int. Cl.[4] ..... B22D 11/06; B22D 11/10; B22D 27/15

[52] U.S. Cl. ..... 164/463; 164/253; 164/423; 164/429; 164/474; 164/479

[58] Field of Search ..... 164/462, 463, 474, 479, 164/253, 423, 429

[56] References Cited

U.S. PATENT DOCUMENTS

| | | | |
|---|---|---|---|
| 3,032,890 | 5/1962 | Brick et al. | 34/242 X |
| 3,888,300 | 6/1975 | Guichard et al. | 164/451 X |
| 4,257,830 | 3/1981 | Tsuya et al. | 164/479 X |
| 4,301,855 | 11/1981 | Suzuki et al. | 164/423 X |
| 4,471,831 | 9/1984 | Ray | 164/423 X |

*Primary Examiner*—Nicholas P. Godici
*Assistant Examiner*—J. Reed Batten, Jr.
*Attorney, Agent, or Firm*—P. Y. Yee; J. Reisenfeld

[57] ABSTRACT

A method and apparatus for continuously casting a filament within a region of preselected vacuum and passing the filament to ambient region of higher pressure include a rotating casting wheel which has an annular peripheral quench surface. A guide housing encloses the casting wheel to separate the wheel from the ambient region and to delimit a guide region which is adapted to pass the filament therethrough to an exit region communicating into the ambient region. An extrusion housing delimits an extrusion chamber which communicates with the guide housing and has a portion of the quench surface disposed therein. An extrusion mechanism located in the extrusion chamber extrudes molten metal onto the quench surface to form the filament, and an extrusion vacuum mechanism provides a preselected vacuum in the extrusion chamber. A fluid jet mechanism disposed in the guide housing reduces the pressure in the extrusion chamber and directs the filament through the guide region. A passivator mechanism passivates the quench surface, and an airlock mechanism substantially preserves the vacuum in the extrusion chamber while simultaneously passing the filament to the ambient region.

8 Claims, 6 Drawing Figures

METHOD OF AND APPARATUS FOR CONTINUOUSLY CASTING METAL FILAMENT IN A VACUUM

CROSS-REFERENCE TO PRIOR APPLICATION

This application is a continuation-in-part of application Ser. No. 458,250, filed Jan. 17, 1983, abandoned.

BACKGROUND OF THE INVENTION

1. Field of the Invention

The invention relates to the continuous casting of a filament within a zone of effective vacuum. More particularly, the invention relates to an apparatus and method for continuously casting a glassy metal filament in a vacuum and continuously transporting the filament to an ambient atmosphere.

2. Description of the Prior Art

In the production of a glassy alloy continuous filament, an appropriate molten alloy is typically quenched at extremely rapid quench rates, usually at least about $10^4$° C. per second, by extruding the molten alloy from a pressurized reservoir through an extrusion nozzle onto a high speed quench surface, as is representatively shown in U.S. Pat. No. 4,142,571 for "Continuous Casting Method for Metallic Strips" issued March 6, 1979 to M. Narasimhan. U.S. Pat. No. 4,077,462 for "Chill Roll Casting of Continuous Filament" issued March 7, 1978 to Bedell, et al. shows a representative apparatus for casting metal filament on the peripheral surface of an annular chill roll. The apparatus has an arcuate, stationary housing disposed about the peripheral surface of the chill roll to delimit a gap between the chill roll peripheral surface and the housing interior, and has a means for providing a fluid stream into the gap.

Vacuum casting is ordinarily accomplished by locating a casting operation in an evacuated vacuum chamber, as representatively shown in U.S. Pat. No. 4,154,283 for "Production of Improved Metal Alloy Filaments" issued May 15, 1979 to R. Ray, et al. Then, after casting the filament, the chamber is opened to remove the filament. Such procedure is particularly tedious and inefficient because it in necessary to stop the casting operation,, break the seal of the vacuum chamber to remove the filament and then reseal and restart the casting operation. Because of the very high casting speeds, the cast filament accumulates very rapidly, often piling onto the casting chamber floor and requiring frequent interruption of the casting operation to remove the filament. A winder mechanism may be located in the evacuated chamber, but this would involve pumping down a chamber large enough to contain the winder device as well as the casting equipment.

U.S. Pat. No. 3,888,300 for "Apparatus for the Continuous Casting of Metals and the Like under Vacuum" issued June 10, 1975 to C. Guichard, et al. shows a device for casting a metal ingot in a vacuum. The device includes a dynamic airlock comprised of several suction chambers and includes rollers which support and center the ingot in the suction chambers as it moves therethrough. U.S. Pat. No. 2,367,174 for "Seal for Gas Pickling Furnace Muffles" issued Jan. 9, 1945 to R. F. Renkin shows a sealing structure comprised of a housing which contains pairs of sealing rollers. U.S. Pat. No. 3,032,890 for "Sealing Structures for Treating Chambers" issued May 8, 1962 to R. M. Brick, et al. shows a sealing structure comprised of a housing having pairs of rollers located therein, and means for exhausting any gases that leak into the areas between roller pairs.

When vacuum casting filaments at high speeds, however, the filament does not reliably exit the evacuated casting chamber without experiencing entanglements and choking of material in the exit sealing structure. In addition, the quench surface can become sensitized, causing the cast filament to adhere or "weld" onto the surface instead of breaking away as ordinarily occurs when casting in an atmosphere. This not only disrupts the casting operation but can also damage the casting equipment. As a result, conventional casting apparatus do not satisfactorily vacuum cast continuous filaments at high speed.

SUMMARY OF THE INVENTION

This invention provides an apparatus for continuously casting a filament, such as a glassy metal filament, within a region of preselected vacuum. The apparatus reliably transfers the cast filament from the vacuum casting region to an ambient region of higher pressure, minimizes welding between the filament and the casting surface and produces filament with superior surface finish. Generally stated, the apparatus includes a rotating casting wheel which has an annular peripheral quench surface and is enclosed inside a guide housing. The guide housing separates the wheel from the ambient region and delimits a guide region which is adapted to guide and pass the filament therethrough to a guide housing exit region communicating into the ambient region. An extrusion housing delimits an extrusion chamber which communicates with the guide housing and has at least a portion of the quench surface disposed therein. An extrusion means located in the extrusion chamber extrudes molten metal onto the quench surface to form the filament, and an extrusion vacuum means provides a preselected vacuum in the extrusion chamber. Fluid jet means disposed in the guide housing reduce the pressure therein and direct the filament through the guide region. A passivator means passivates the quench surface, and an airlock means located at the guide housing exit region substantially preserves the vacuum in the extrusion chamber while continuously passing the filament to the ambient region.

In accordance with the invention, there is further provided a method for continuously casting a metal filament within a region of preselected vacuum. Molten alloy is extruded onto a moving quench surface of a rotating casting wheel located within the vacuum region to cast the filament. The quench surface is passivated to inhibit adherence of the filament to the quench surface. The filament is then directed with fluid jet means through a guide region and an exit passage which communicates with an ambient region of higher pressure. The preselected vacuum in the vacuum region is substantially preserved with airlock means as the filament is continuously passed to the ambient region.

By casting the filament in a vacuum, the apparatus of the invention improves the heat transfer during the quenching operation and improves the surface finish of the cast filament. Since the apparatus continuously removes filament from the evacuated casting zone simultaneous with a casting operation, it eliminates the need to repeatedly interrupt the high speed casting operation to remove filament which has accumulated inside the evacuated casting chamber. The apparatus also avoids the need to evacuate a chamber large enough to contain a high speed winder device because it efficiently preserves the vacuum in a small casting zone while continuously removing the rapidly cast filament to a winder located in the ambient atmosphere. In addition, the apparatus cleanly exits the cast filament through the exit airlock structure without choking the exit, and eliminates excessive adhesion between the filament and quench surface.

Thus, the invention provides an apparatus and method for vacuum casting a continuous filament in a highly efficient manner. The filament is cast at high speed within an effective vacuum zone of minimum size and then continuously and simultaneously transported to an ambient atmosphere. Compared to conventional vacuum casting apparatus and techniques without passivator means, the present invention is more compact, better able to move a rapidly advancing filament cleanly through an exit airlock structure without choking or entanglement, and less susceptible to welding between the cast filament and the quench surface.

BRIEF DESCRIPTION OF THE DRAWINGS

The invention will be more fully understood and further advantages will become apparent when reference is made to the following detail description of the preferred embodiments of the invention and the accompanying drawings in which.

DESCRIPTION OF THE PREFERRED EMBODIMENTS

The invention is suitable for vacuum casting polycrystalline filament of aluminum, tin, copper, iron, steel, stainless steel or the like. However, metal alloys that, upon cooling from the melt form solid amorphous (glassy) structures are preferred. These alloys are known to those skilled in the art, and examples are disclosed in U.S. Pat. Nos. 3,427,154; 3,981,722 and others.

Glassy metal filaments are necessarily thin, typically about 15 to 100 microns, due to the extremely rapid heat transfer rate required to prevent substantial crystallization though considerable selectivity may be exercised respecting the transverse dimensions and cross section of the filament. Thus, in the specification and claims, the term "filament" is intended to include strips, both narrow and wide, as well as wire-like filaments. The requirement of an extremely rapid quench rate in turn necessitates casting the filament at very high speeds; the cast filament typically advances off the quench surface at 500 to 2000 meters per minute.

Figure 1:
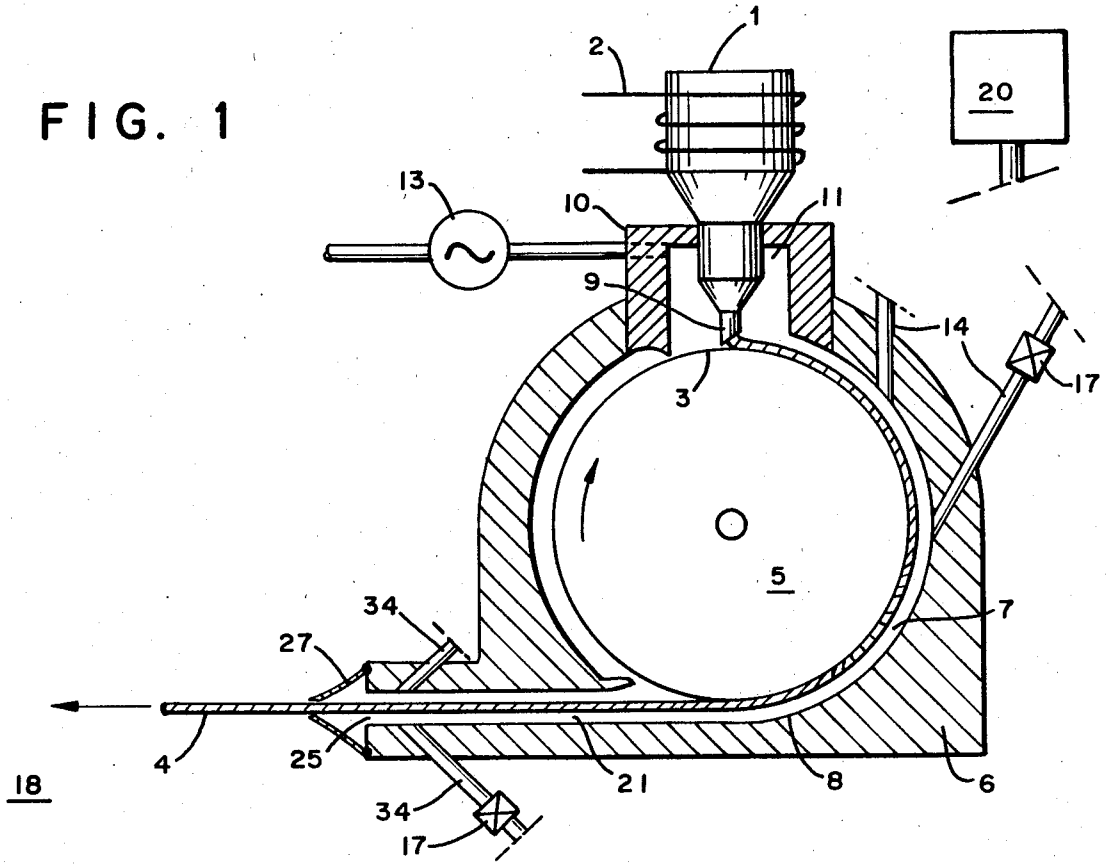
FIG. 1 is a cross-sectional schematic representation of the apparatus of the invention.

Referring to FIG. 1 of the drawings, there is illustrated a cross-sectional schematic representation of a high speed continuous vacuum casting apparatus of the invention. Casting wheel 5 has an annular peripheral quench surface 3 and rotates to provide a quench surface speed of at least about 500 m/min. Guide housing 6 encloses wheel 5 and delimits a guide region comprised of gap region 7 and guide passage 21. An extrusion housing 10 mounted on guide housing 6 delimits an extrusion chamber 11 which contains an extrusion means and has a portion of quench surface 3 disposed therein. An extrusion vacuum means, such as vacuum pump 13, provides a preselected vacuum in the extrusion chamber. High velocity fluid jet means, disposed in guide housing 6 and comprised of at least one but preferably a plurality of jet nozzles 14, reduce the pressure in the guide housing and direct the filament through the guide region. Jet nozzles 14 also provide a passivator means for passivating quench surface 3. An exit airlock means, such as the shown opposed flap configuration of flexible seals 27, is disposed at the exit of guide passage 21 and adapted to simultaneously and continuously pass a cast filament, such as glassy metal filament 4, to ambient region 18.

By casting filament 4 in a vacuum, the present apparatus significantly improves the heat transfer during the quenching operation on quench surface 3. The evacuated extrusion chamber eliminates the atmospheric gases which tend to interpose between quench surface 3 and the extruded molten metal inhibiting the heat transfer therebetween. The apparatus also improves the as-cast surface finish of filament 4. The extrusion chamber vacuum eliminates gases that can cause airpocket-type imperfections on the quench surface side of filament 4, and also eliminates the turbulent gas boundary layer that can cause waviness and other surface imperfections on the free surface side of the cast filament. Reducing these imperfections improves the uniformity of the filament cross section.

Since the cast filament is continuously and simultaneously transported and passed out from extrusion chamber 11 through the airlock means, the need to locate a high speed winder device within a large evacuated chamber is eliminated and the sizes of extrusion chamber 11 and extrusion housing 10 are minimized.

In the casting of glassy metal filament, casting wheel 5 is typically about 14 inches in diameter and rotates at a speed of about 1400 revolutions per minute to provide the rapid quench rates needed to produce glassy metal alloy. Guide housing 6 encloses wheel 5 to separate and isolate quench surface 3 from the atmosphere in ambient zone 18. A portion of guide housing 6 delimits a gap region 7 between quench surface 3 and an interior housing surface 8, the transverse width dimension of the gap being suitably sized and configured to accommodate the passage of filament 4. The gap separation distance between quench surface 3 and interior surface 8 can range from about 25 to about 200 times the thickness of filament 4, but preferably ranges from about 50 to about 100 times the thickness of the filament. Guide housing 6 further delimits a guide passage 21 which guides filament 4 after it breaks away from wheel 5. Passage 21 is suitably sized and configured to accommodate passage of filament 4.

The dimension of passage 21 corresponding to the thickness of filament 4 again ranges from about 25 to 200 times the filament thickness, and preferably ranges from about 50 to 100 times the filament thickness. In addition, passage 21 is substantially free of protrusions or obstructions that could interfere with the filament passage and cause choking, bunching or entanglements of the thin and flexible filament 4 therein.

Extrusion housing 10 mounted on guide housing 6 delimits an extrusion chamber 11 which communicates with guide housing 6 and has at least a portion of quench surface 3 disposed therein. An extrusion means located in chamber 11 extrudes molten metal onto quench surface 3 to form filament 4, and in the shown embodiment, the extrusion means is comprised of crucible 1 and nozzle 9. Crucible 1 contains the molten metal and has a heating element 2. Pressurization of the crucible with an inert gas extrudes a molten stream through nozzle 9 at the base of the crucible onto quench surface 3.

An extrusion vacuum means, such as a vacuum pump 13, evacuates the atmosphere from extrusion chamber 11 to maintain a preselected vacuum therein. Preferably, pump 13 should be capable of producing a vacuum of less than about 55 mm Hg of pressure.

The fluid jet means, comprised of at least one but preferably a plurality of jet nozzles 14 and 34, are preferably angled in the direction of movement of filament 4 to better direct the filament about wheel 5 and through guide passage 21. A suitable pressurized fluid, such as pressurized air, moves from a fluid source 20 through appropriate conduits to each of the individual jet nozzles. Since each jet nozzle is provided with a control valve means 17 for controlling the volume and velocity of air entering the individual nozzles, each fluid jet stream can be individually controlled and modulated to provide a desired directing force.

The jets from nozzles 14 not only guide filament 4 around wheel 5 but also passivate quench surface 3. Ordinarily, the high speed vacuum casting of continuous filament is seriously limited by the tendency of the quench surface to become sensitized, and when this occurs, filament 4 adheres excessively or "welds" to quench surface 3 during the casting process. This disrupts the casting operation, and the agglomerated material welded to the quench surface can come around to strike and damage the casting equipment. The air from the jets, however, passivates quench surface 3 to inhibit and substantially prevent the welding of filament 4 thereto. While not intending to be bound by any particular theory, it is believed that a layer of gas molecules adsorbed onto quench surface 3 acts to inhibit welding.

The jet velocities through nozzles 14 and 34 should be at least equal to the velocity of moving filament 4 to prevent separation of the filament from wheel 5 and prevent bunching, of the filament within gap 7 and passage 21. However, by ejecting air at a velocity of approximately 100 ft/sec (30.5 m/sec), the jet streams produced by nozzles 14 and 34 also serve to reduce the pressure in guide housing 6 and extrusion chamber 11. In accordance with Bernoulli's Law, the high velocity jets reduce the static pressures in gap 7 and guide passage 21 which in turn reduce the pressure and provide a degree of vacuum in extrusion chamber 11. If only a relatively soft vacuum having a pressure of not less than 300 mm Hg is required, pump 13 and the jets from nozzles 14 and 34 are sufficient to maintain the desired vacuum in extrusion chamber 11. However, if a harder vacuum having a pressure less than 300 mm Hg is required, for example less than 100 mm Hg, additional exit airlock means can be used at exit 25 of guide passage 21 to inhibit the influx of the ambient atmosphere.

To provide such an exit airlock, hinged or flexible flap seals 27 may be located at exit 25 of guide passage 21. Seals 27 are urged toward filament 4, for example by their flexible resilience, and are adapted to provide a convergent entry region thereinto which converges toward the direction of filament travel. The convergent region guides filament 4 through the seals and minimizes interference which could cause filament bunching and clogging at exit 25. Seals 27 are, for example composed of a heat resistant elastomer or metal.

Figure 5A:
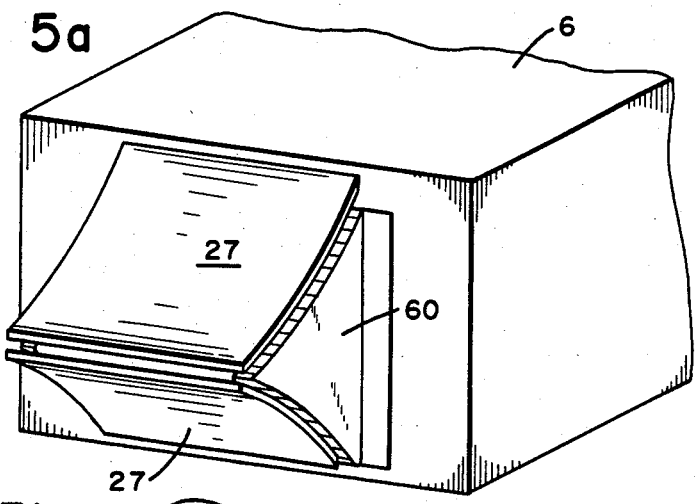
FIGS. 5*a* and 5*b* show a more detailed view of the exit flap seals.
Figure 5B:
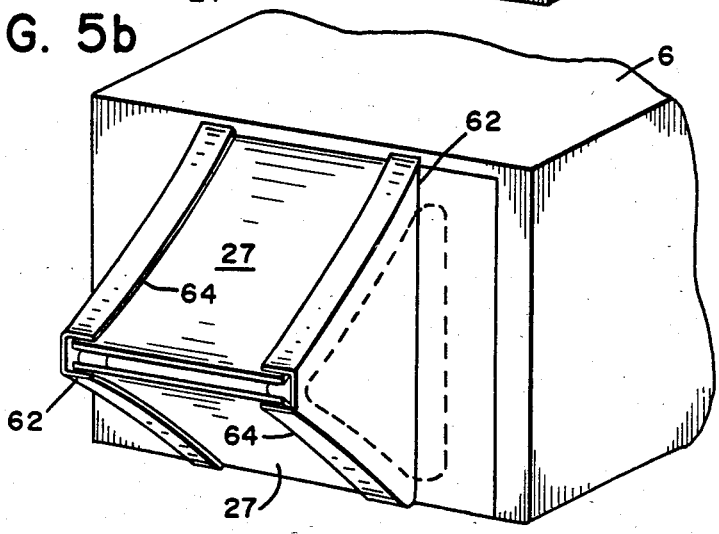

As representatively shown in FIGS. 5*a* and 5*b*, a web support 60 connects to the exit portion of housing 6 and is contoured to fit in the opening at the side edges of flap seals 27. Support 60 minimizes excessive collapsing of the flaps. A sealing web 62 connects to housing 6 and is located outside of support 60, extending over the support. The sealing web covers the edge opening and contacts the edges of flaps 27 to form an effective seal. In addition, the edges of sealing web 62 may be bent and contoured to form a constraining lip portion 64 which restricts the opening movements of flap 27.

Figure 2:
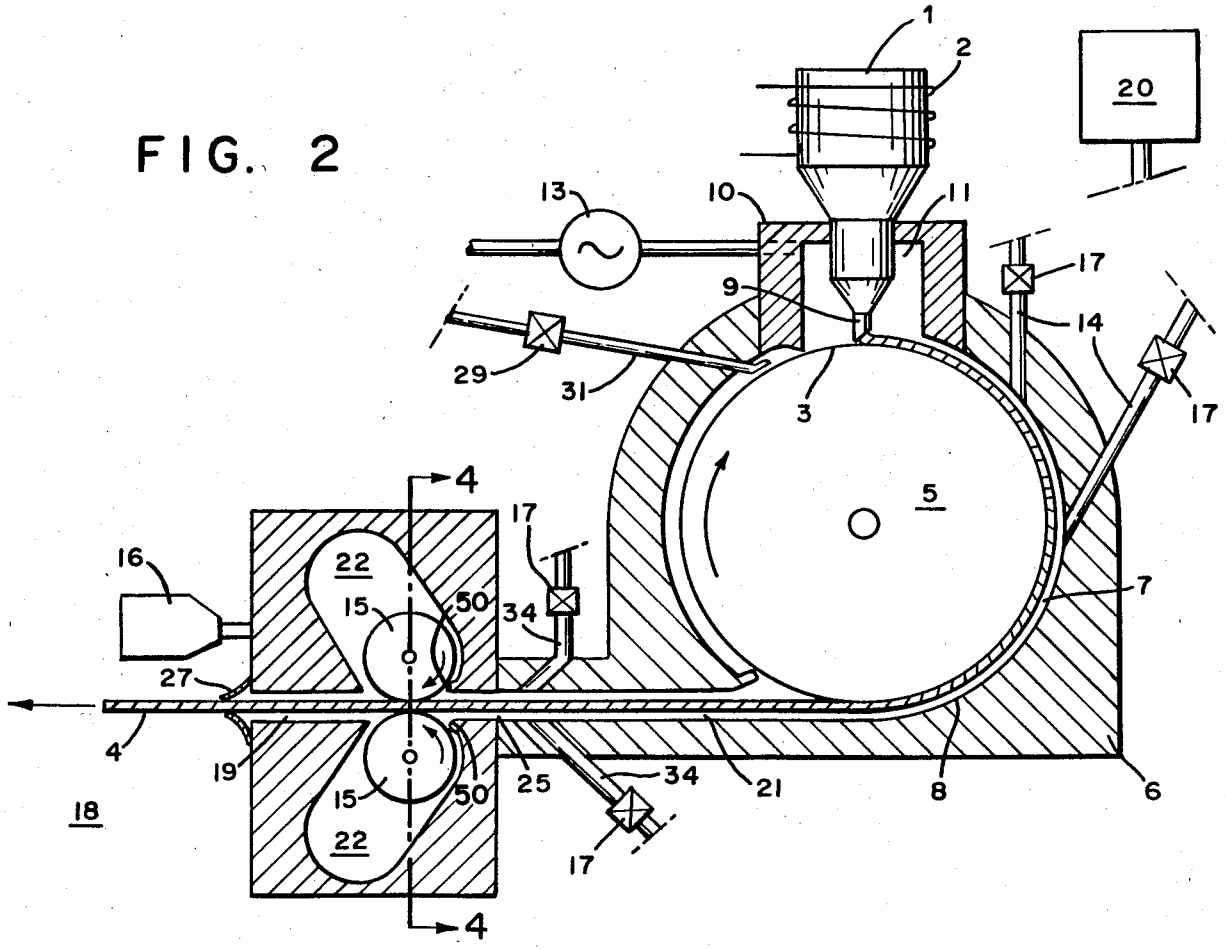
FIG. 2 is a cross-sectional schematic representation of an embodiment of the invention which illustrates an exit airlock comprised of a pair of sealing rollers.

Preferably, the exit airlock is comprised of a system of sealing rollers. As illustrated in FIG. 2, an exit housing 12, which delimits an exit passage 19 and contains at least one pair of counter-rotating rollers 15, is located at the exit of guide passage 21. Exit passage 19 is arranged to communicate with guide passage 21; and paired rollers 15 are adapted to pass filament 4 through the nip area therebetween, contact filament 4 and substantially seal the guide passage exit against the ambient atmosphere. The circular end faces of rollers 15 slidably contact and effectively seal against the side walls of exit housing 12, and the peripheral surfaces of rollers 15 slideably contact and effectively seal against an upstream wall portion 50 of the exit housing. The contacting, upstream wall portion extends across the total width of roller bay 22 for optimum effectiveness, and is preferably composed of a flexible or resilient material such as rubber. Suitable drive means, such as a motor, counter-rotate rollers 15 such that the peripheral velocity of the rollers at the nip area approximately and substantially matches the velocity of advancing filament 4. The rollers are then able to transport filament 4 to ambient region 18.

Figure 4:
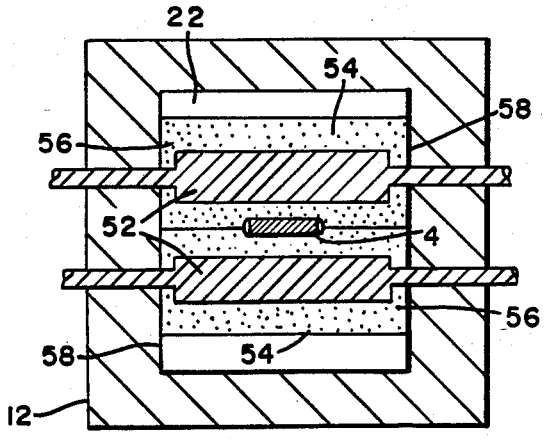
FIG. 4 shows a cross-sectional view taken along line 4—4 of FIG. 2.

FIG. 4 shows an embodiment of the invention where rollers 15 are comprised of a rigid center body 52 composed of metal or plastic surrounded by a concentric outer layer 54 composed of a softer, resilient, elastomeric material such as rubber. This outer layer readily deforms to effectively seal around strip 4 when they close against it. In the roller nip region, the outer layers 54 squeeze against the strip and conform to the strip contour. Each of the ends of the rollers also has a softer layer portion 56 which contacts and effectively seals against the corresponding, adjacent sidewall 58 of housing 12. End portion 56 may be shaped as a disk or annular ring, and a lubricant, such as a low viscosity vacuum grease, may be used at the interface between sidewalls 58 and roller end portions 56 to reduce friction.

In addition, rollers 15 are preferably provided with suitable actuator means 16 for selectively opening and closing the rollers against filament 4. By activating actuator 16 to retract rollers 15 into roller bays 22, the movement of filament 4 through passage 19 can be established without interference from the rollers. This prevents bunching of the filament which would choke passage 19. Once movement of filament 4 through passage 19 is established, actuator 16 is actuated to close rollers 15 against the filament and form the desired seal.

Figure 3:
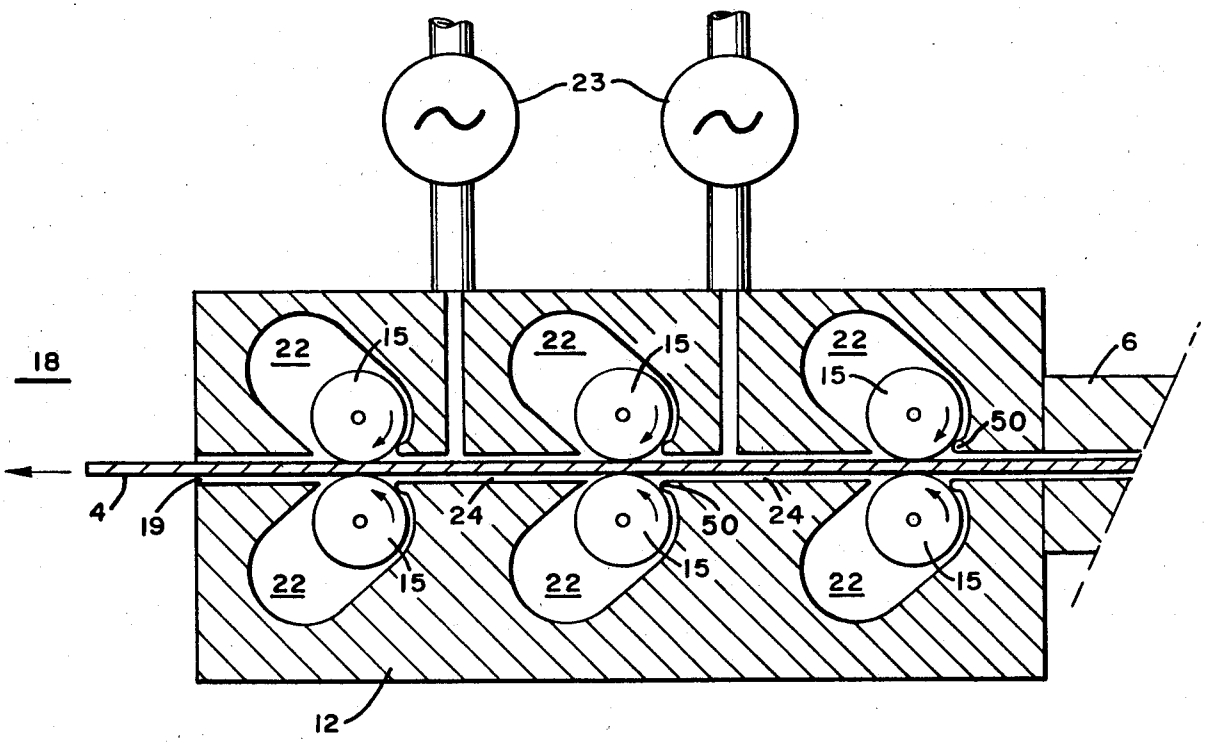
FIG. 3 is a cross-sectional schematic representation of an airlock means of the invention which has a plurality of counter-rotating roller pairs located in series.

FIG. 3 shows an embodiment of the airlock means having a plurality of counter-rotating paired rollers 15 serially located in exit housing 12 along exit passage 19. By providing multiple barriers in series, such a configuration provides an improved seal against the intrusion of the ambient atmosphere. The seal can be further enhanced by suitable exit vacuum means, such as vacuum pumps 23, which provide a preselected vacuum level within each exit passage intermediate region 24 located between two successive roller pairs.

During operation, rollers 15 are initially retracted into roller bays 22 away from the path of filament 4, and pump 13 is actuated to produce the desired vacuum in extrusion chamber 11. Control valves 17 are opened to provide high velocity jet streams through nozzles 14 and 34 into gap 7 and passage 21, respectively. Wheel 5 is then spun up to the appropriate casting speed, and molten metal is extruded onto quench surface 3 to produce a rapidly advancing filament 4. The air jets from nozzles 14 and 34 maintain the contact of filament 4 against quench surface 3 and direct the filament around wheel 5, through passage 21 and into passage 19 through housing 12. After establishing the passage of filament 4 through housing 12, rollers 15 are spun up to match the velocity of advancing filament 4 and then moved into rolling contact therewith. Control valves 17 are then turned off substantially simultaneous with the contact of the rollers with filament 4, and the vacuum casting proceeds. To passivate quench surface 3, a small amount of air is bled into housing 6 through bleed valve 29 and bleed line 31, and is directed against the quench surface. The amount of air is suitably regulated to ensure adequate passivation of the quench surface but still allow pump 13 to maintain the required degree of vacuum in chamber 11.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for continuously casting a filament within a region of preselected vacuum and passing the filament to an ambient region of higher pressure, comprising:

(a) a rotating casting wheel having an annular, peripheral quench surface;

(b) a guide housing enclosing said casting wheel to separate said wheel from said ambient region and to delimit a guide region which is adapted to guide and pass said filament therethrough to a guide housing exit region communicating into said ambient region;

(c) an extrusion housing delimiting an extrusion chamber which communicates with said guide housing and has at least a portion of said quench surface disposed therein;

(d) an extrusion means located in said extrusion chamber for extruding molten metal onto said quench surface to form said filament;

(e) extrusion vacuum means for providing a preselected vacuum in said extrusion chamber;

(f) fluid jet means disposed in said guide housing for reducing the pressure therein and directing said filament through said guide region;

(g) passivator means for passivating said quench surface to inhibit welding of said filament to said quench surface; and (h) airlock means located at said guide housing exit region for substantially preserving said vacuum in said extrusion chamber while continuously passing said filament to said ambient region.

2. An apparatus as recited in claim 1, wherein said airlock means comprises:

(a) an exit housing which delimits an exit passage communicating between said guide housing exit region and said ambient region;

(b) at least one pair of counter-rotating rollers disposed in said exit passage, said rollers being adapted to pass said filament through the nip therebetween to provide a contact type seal aganst said filament and to direct said filament to said ambient region; and (c) actuator means for selectively closing said rollers against said filament to produce said seal.

3. An apparatus as recited in claim 2, wherein a plurality of said counter-rotating roller pairs are serially located along said exit passage and delimit an intermediate passage region between successive roller pairs.

4. An apparatus as recited in claim 3, further comprising exit vacuum means for providing a preselected vacuum levels within said intermediate regions.

5. A method for continuously casting a metal filament within a region of preselected vacuum, comprising the steps of:

(a) extruding molten alloy onto a moving quench surface of a rotating casting wheel located within said vacuum region to cast said filament;

(b) passivating said quench surface to inhibit adherence of said filament thereto;

(c) directing said filament with fluid jet means through a guide region and an exit passage which communicates with an ambient region of higher pressure; and (d) substantially preserving the preselected vacuum in said vacuum region with airlock means as said filament is continuously passed to said ambient region.

6. A method as recited in claim 5, wherein said preserving step (d) further comprises the steps of:

(e) passing said filament through the nip of at least one pair of counter-rotating rollers located in said exit passage which are adapted to provide a contact type seal against said filament and direct said filament to said ambient region; and (f) selectively closing said rollers against said filament to produce said seal.

7. A method as recited in claim 6, wherein said step (e) further comprises the step of passing said filament through the nips of a plurality of counter-rotating roller pairs which are located in series along said exit passage and delimit an intermediate passage region between successive roller pairs.

8. A method as recited in claim 7, further comprising the step of providing a preselected vacuum level within said intermediate passage regions.

* * * * *